US009136614B2

(12) United States Patent
Sasano et al.

(10) Patent No.: US 9,136,614 B2
(45) Date of Patent: Sep. 15, 2015

(54) CONDUCTOR CONNECTION TOOL AND RELAY UNIT USING THE SAME

(75) Inventors: Naoya Sasano, Hachioji (JP); Makoto Sato, Okayama (JP); Motoyuki Tomizu, Okayama (JP); Jun Yamane, Kizugawa (JP); Shinya Iwasaki, Ritto (JP); Naoki Ueno, Higashiomi (JP)

(73) Assignee: OMRON Corporation, Kyoto (JP)

( * ) Notice: Subject to any disclaimer, the term of this patent is extended or adjusted under 35 U.S.C. 154(b) by 254 days.

(21) Appl. No.: 13/547,515

(22) Filed: Jul. 12, 2012

(65) Prior Publication Data

US 2014/0017930 A1 Jan. 16, 2014

(30) Foreign Application Priority Data

Sep. 8, 2011 (JP) ..... 2011-195982

(51) Int. Cl.

| | |
|---|---|
| ***H01R 4/24*** | (2006.01) |
| ***H01R 4/48*** | (2006.01) |
| ***H01R 9/24*** | (2006.01) |
| ***H01R 13/11*** | (2006.01) |

(52) U.S. Cl.

CPC ..... *H01R 4/4827* (2013.01); *H01R 9/2425* (2013.01); *H01R 13/112* (2013.01)

(58) Field of Classification Search

CPC ..... H01R 4/4818
USPC ..... 439/441, 439–440
See application file for complete search history.

(56) References Cited

U.S. PATENT DOCUMENTS

| | | | | |
|---|---|---|---|---|
| 5,253,140 | A * | 10/1993 | Inoue et al. | 361/728 |
| 5,654,730 | A * | 8/1997 | Tanaka | 345/87 |
| 5,708,717 | A | 1/1998 | Alasia | |
| 5,961,335 | A | 10/1999 | Kubernus et al. | |
| 6,851,967 | B2 * | 2/2005 | Miyoshi et al. | 439/441 |
| 6,981,890 | B2 * | 1/2006 | Cutler et al. | 439/441 |
| 7,287,999 | B2 * | 10/2007 | Holterhoff et al. | 439/441 |
| 7,785,134 | B2 * | 8/2010 | Dhandapani et al. | 439/441 |
| 7,896,685 | B2 * | 3/2011 | Eppe et al. | 439/441 |

(Continued)

FOREIGN PATENT DOCUMENTS

| | | | |
|---|---|---|---|
| CN | 1207818 | A | 2/1999 |
| DE | 102009004513 | A1 | 7/2010 |

(Continued)

OTHER PUBLICATIONS

Chinese Office Action Dated Aug. 12, 2014 With English Translation.

*Primary Examiner* — Neil Abrams
(74) *Attorney, Agent, or Firm* — Klarquist Sparkman, LLP

(57) ABSTRACT

A conductor connection tool includes a terminal platform base, a conduction fitting accommodated in a fitting recessed part of the terminal platform base. The conduction fitting is formed in a substantially U shape and includes a bottom plate portion, a vertical portion bent vertically upward from one end of the bottom plate portion, and an attachment portion extending from an upper end of the vertical portion in parallel to the bottom plate portion, and having a terminal portion extending in the opposite direction to the attachment portion. A plate spring bent in a substantially V shape with one side serving as an attachment piece to be fixed to the attachment portion of the conduction fitting with the other side serving as a locking piece whose front end is to be brought into pressure contact with the bottom plate portion of the conduction fitting.

3 Claims, 14 Drawing Sheets

(56) References Cited

U.S. PATENT DOCUMENTS

| | | | | |
|---|---|---|---|---|
| 8,011,936 | B2 * | 9/2011 | Goto | 439/76.1 |
| 8,113,864 | B2 * | 2/2012 | Chiang | 439/347 |
| 8,251,738 | B2 * | 8/2012 | Heckert et al. | 439/441 |
| 8,342,891 | B2 * | 1/2013 | Fukushi | 439/752 |
| 8,485,841 | B2 * | 7/2013 | Schrader | 439/441 |
| 8,858,269 | B2 * | 10/2014 | Brand et al. | 439/733.1 |
| 2004/0102078 | A1 | 5/2004 | Miyoshi et al. | |
| 2011/0207361 | A1 | 8/2011 | Heckert et al. | |
| 2011/0312228 | A1 | 12/2011 | Schrader | |
| 2012/0264339 | A1 | 10/2012 | Brand et al. | |

FOREIGN PATENT DOCUMENTS

| | | | |
|---|---|---|---|
| JP | 02123069 | U | 10/1990 |
| JP | 04067581 | A | 3/1992 |

* cited by examiner

CONDUCTOR CONNECTION TOOL AND RELAY UNIT USING THE SAME

BACKGROUND OF THE INVENTION

1. Technical Field

The present invention relates to a conductor connection tool called a "relay connector", a self-locking terminal device, a conductor connection connector, and a relay unit, for connecting a conductor such as an electric wire and a rod terminal.

2. Related Art

Conventionally, for example, there is a conductor connection tool for nipping and connecting an electric wire by a conduction fitting and a plate spring accommodated in a housing (refer to DE102009004513 (A1)).

However, in the above conventional example, as clear from FIGS. 9A, 9B and 10A, 10B thereof, a plate spring 10 is fixed to an attachment portion formed by bending an upper edge of a conduction fitting 30. Thus, the attachment portion is pushed up by a spring force of the plate spring 10 and easily inclined. Therefore, the plate spring 10 is also inclined and easily brought into partial contact with an electric wire 62, so that a holding force onto the electric wire 62 is weak and contact reliability is low.

Since there is a need for arranging the plate spring 10 in the conduction fitting 30 formed in a substantially U shape in a sectional view, a developing area of the conduction fitting 30 is large. Therefore, the number of the conduction fittings to be cut out from a plate shaped conductive material in a single area is small, so that the production cost is high.

Particularly, in order to make the plate spring 10 function as a stopper for preventing excessive insertion of the electric wire 62, one end of the plate spring 10 is vertically bent. Therefore, the plate spring 10 is long, and the number of the plate springs 10 to be cut out from a plate shaped spring material in a single area is small. Thus, there is a problem that the production cost is increased.

SUMMARY

The present invention has been devised to solve the problems described above, and an object thereof is to provide a conductor connection tool with high contact reliability, favorable material usage, and low production cost, and a relay unit using the same.

In accordance with one aspect of the present invention, a conductor connection tool includes a housing, a conduction fitting formed in a substantially U shape in a front view including a bottom plate portion, a vertical portion bent vertically upward from one end of the bottom plate portion, and an attachment portion extending from an upper end of the vertical portion in parallel to the bottom plate portion, and having a terminal portion extending in the opposite direction to the attachment portion, the conduction fitting being accommodated in a fitting recessed part of the housing, and a plate spring bent in a substantially V shape with one side serving as an attachment piece to be fixed to the attachment portion of the conduction fitting while the other side serving as a locking piece whose front end is to be brought into pressure contact with the bottom plate portion of the conduction fitting, wherein by pushing in the locking piece of the plate spring via an operation hole provided on the front surface side of the housing so as to be elastically deformed, inserting a conductor from a conductor insertion hole provided on the front surface side of the housing, and then elastically returning the locking piece, the conductor is nipped by the bottom plate portion of the conduction fitting and the front end of the locking piece of the plate spring.

According to the present invention, the attachment piece of the substantially V shape plate spring is fixed to the attachment portion of the conduction fitting formed in a substantially U shape in a front view. Thus, a twist as in the conventional example is not applied to the plate spring, and the plate spring is not brought into partial contact with the conductor. Therefore, the conductor connection tool with a strong holding force and high contact reliability can be obtained.

Alternatively, the conduction fitting is formed in a substantially U shape in a front view. Thus, even in a case where the substantially V shape plate spring is arranged inside the conduction fitting, the conduction fitting does not require a large developing area unlike the conventional example. Therefore, the number of the conduction fitting to be cut out from a plate shape conductive material of a single area is increased, so that the production cost can be reduced.

As an embodiment of the present invention, the terminal portion may be bent upward in such a manner that a roll surface to which no press molding is performed becomes a contact surface.

According to the present embodiment, among the terminal portion of the conduction fitting, not a fracture surface generated at the time of press molding but the roll surface is brought into contact with other terminal receiving fitting. Therefore, variation in contact resistance is small, and a contact surface of the terminal receiving fitting is not damaged. Thus, the contact reliability is high.

As another embodiment of the present invention, a substantially L shape positioning rib for regulating a position of the conduction fitting may protrude from a bottom surface of the fitting recessed part.

According to the present embodiment, the conduction fitting can be positioned via the positioning rib, so that an assembling property and assembling precision are improved.

Since a frond end of the conductor inserted into the housing is abutted with the positioning rib, excessive insertion of the conductor can be prevented. Therefore, there is no need for forming the plate spring by bending a long plate shape spring material unlike the conventional example. Thus, material usage of the plate shape spring material is improved, so that the production cost can be reduced.

In accordance with another aspect of the present invention, in a relay unit, the housing in which the conduction fitting and the plate spring are assembled is rotatably attached to a relay unit main body, and the terminal portion of the conduction fitting protruding from the housing is fitted and connected between a pair of elastic arm portions of a terminal receiving fitting provided in a terminal hole of the relay unit.

According to the present invention, the housing is rotatably attached to the relay unit main body. Thus, a connection task can be performed with a single-touch operation, so that maintenance is easily performed.

Particularly, when the housing is detachable from and attachable to the relay unit main body, a connection of the conductor to the housing is easily performed.

DETAILED DESCRIPTION

Figure 1A:
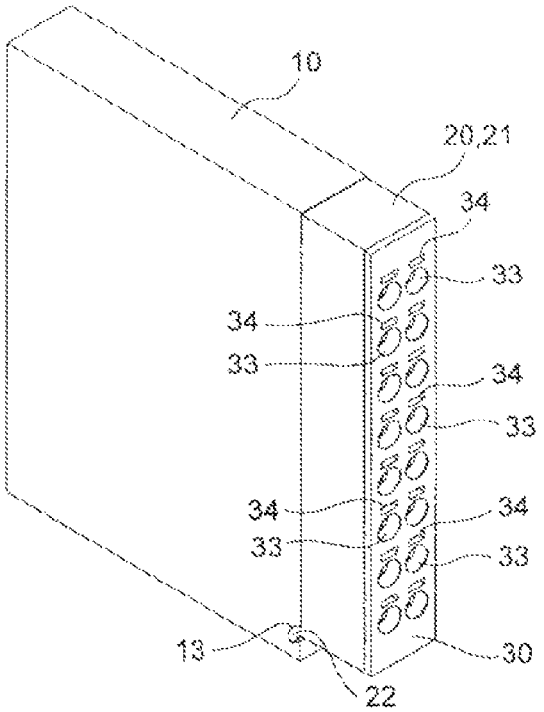
FIGS. 1A and 1B are perspective views showing states before and after connecting a relay unit serving as a first embodiment in which a conductor connection tool according to the present invention is applied.
Figure 1B:
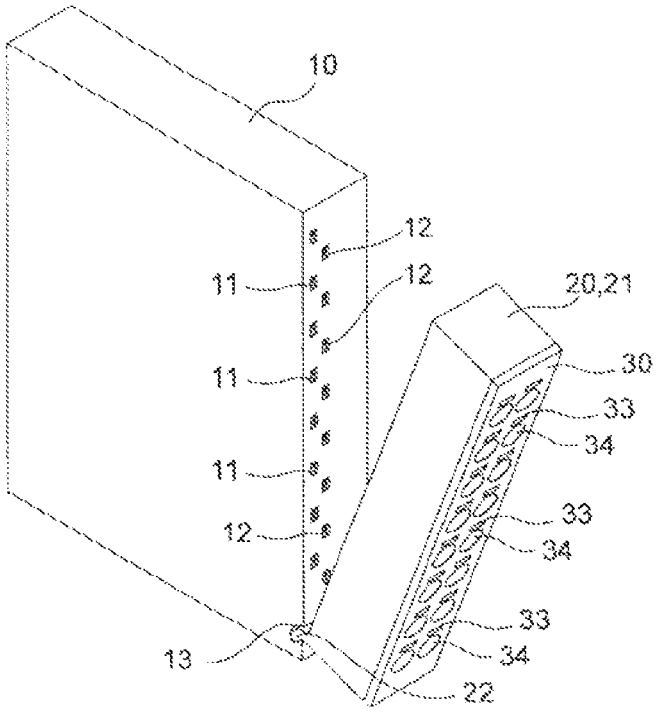
Figure 2A:
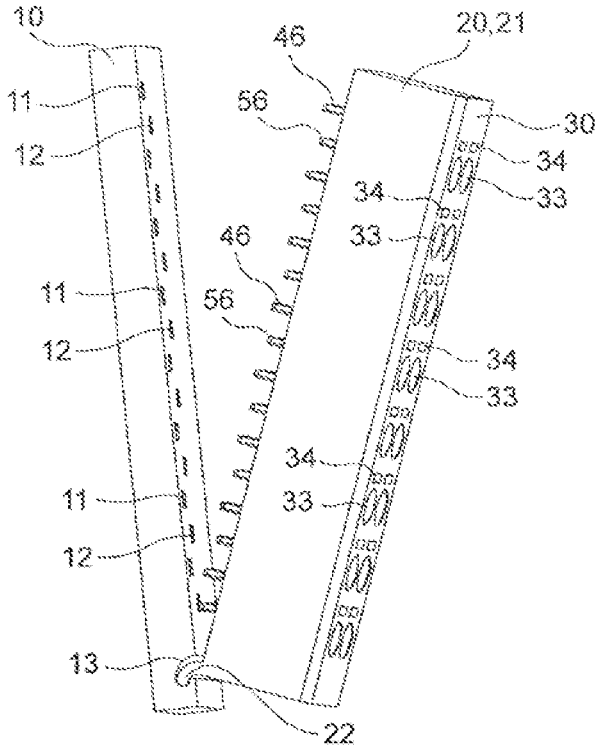
FIGS. 2A and 2B are a partial perspective view before connecting the relay unit shown in FIGS. 1A and 1B, and a perspective view showing only conduction fittings and terminal receiving fittings.
Figure 2B:
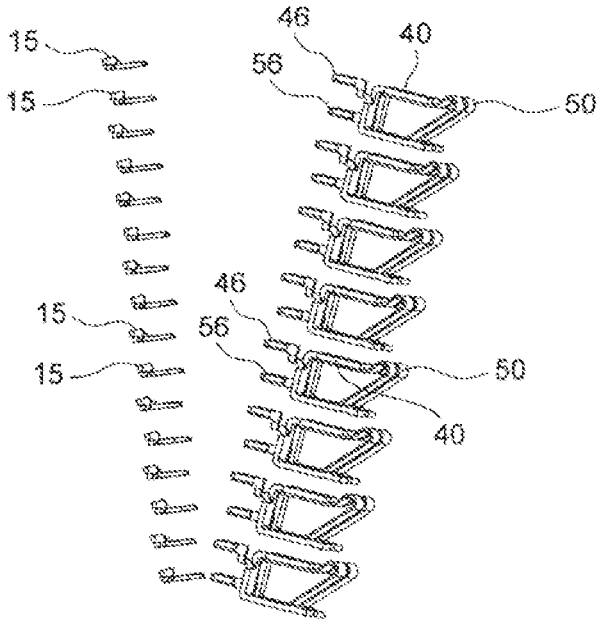
Figure 3A:
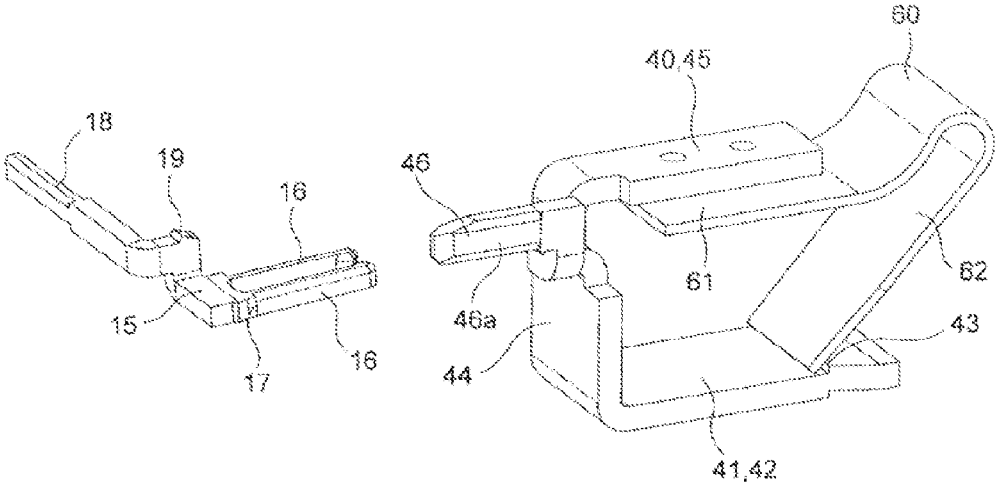
FIGS. 3A and 3B are perspective views illustrating a connection method of the conduction fitting and the terminal receiving fitting.
Figure 3B:
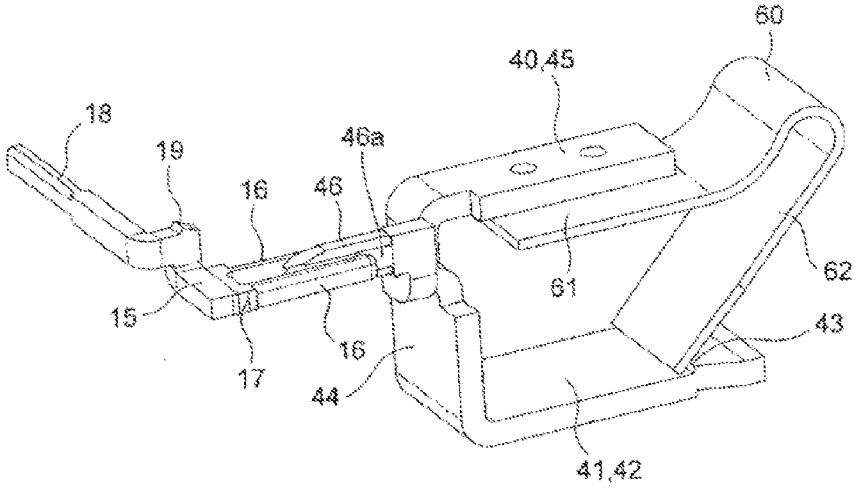
Figure 4A:
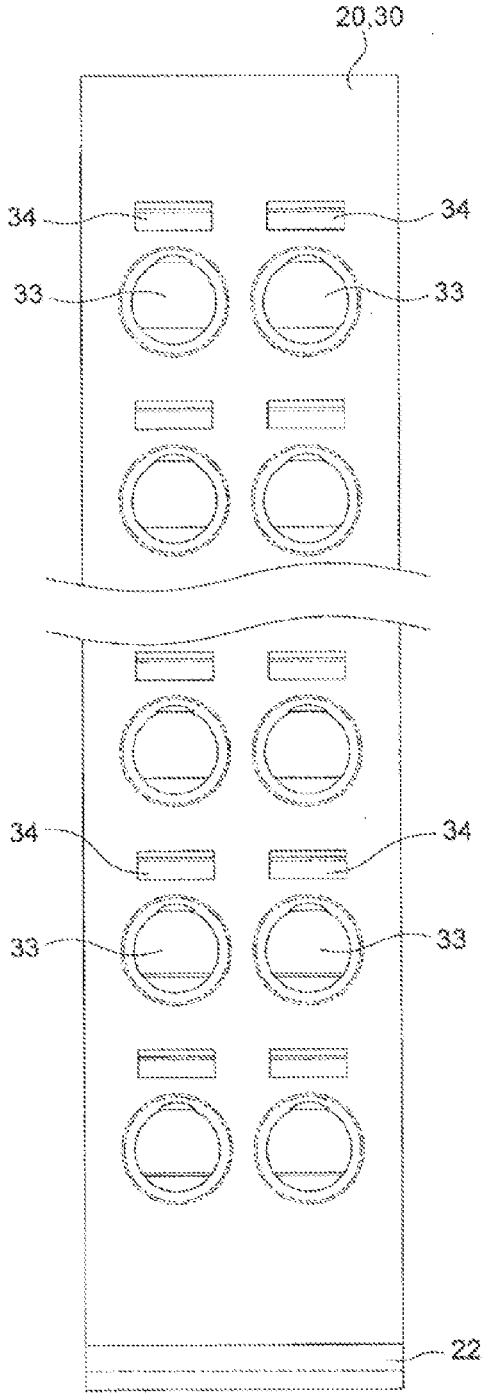
FIGS. 4A and 4B are a partial front view and a partial back view of a terminal platform shown in FIGS. 1A and 1B.
Figure 4B:
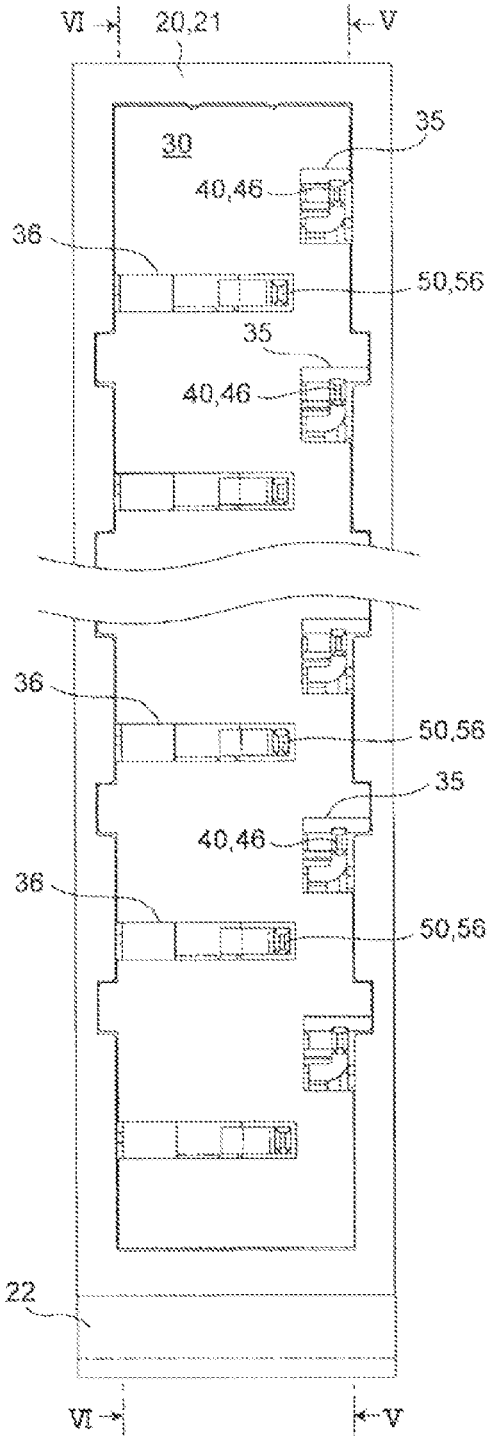
Figure 5A:
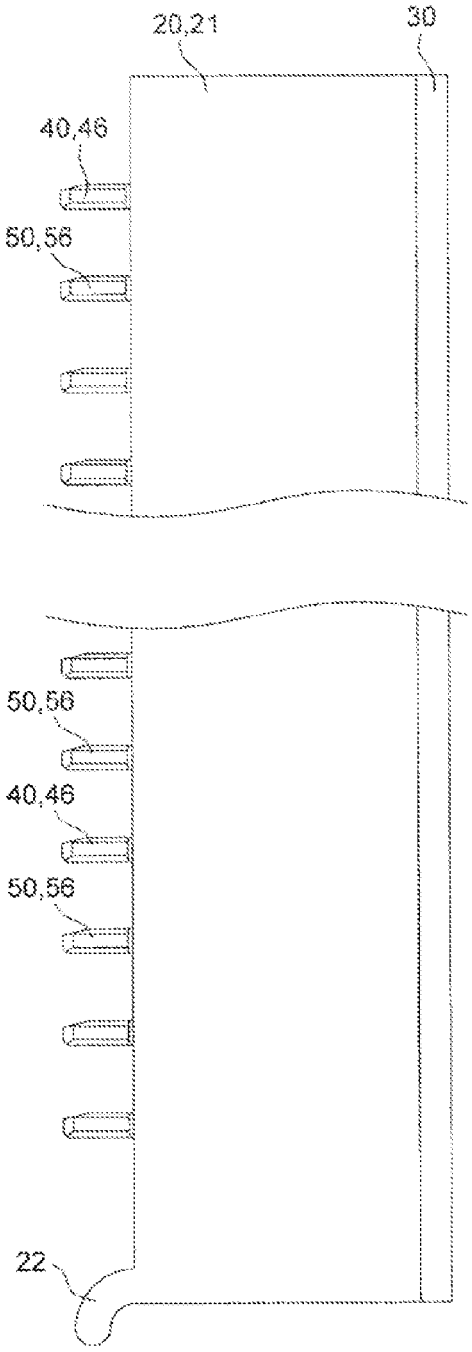
FIG. 5A is a partial left side view of the terminal platform shown in FIGS. 1A and 1B.
Figure 5B:
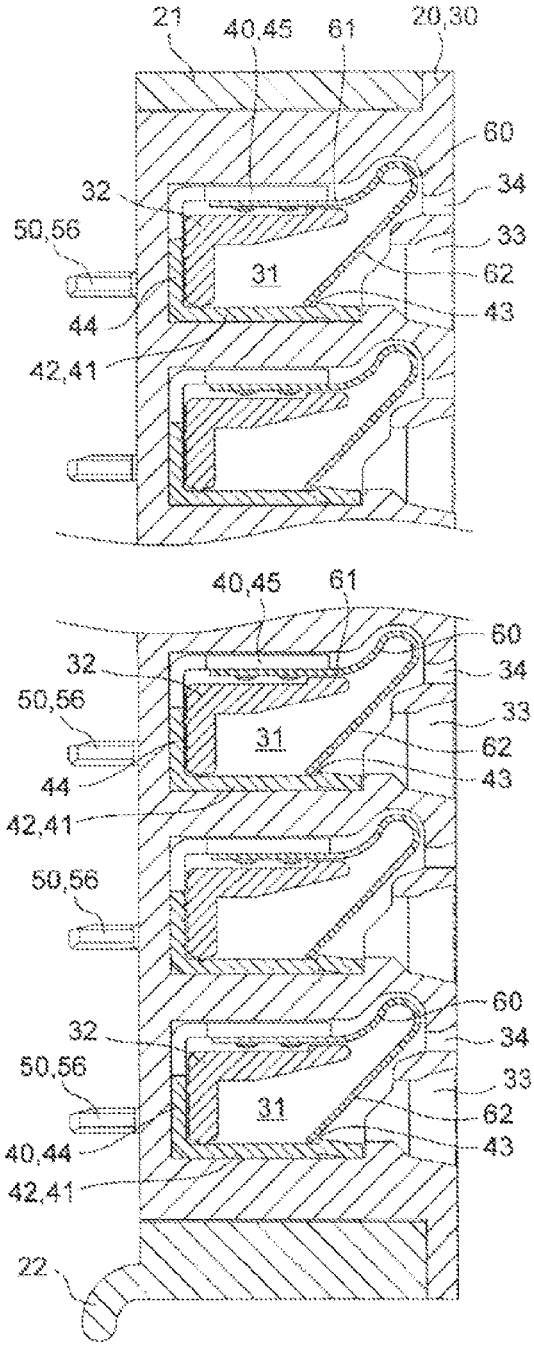
FIG. 5B is a sectional view taken along line V-V in FIG. 4B.
Figure 6A:
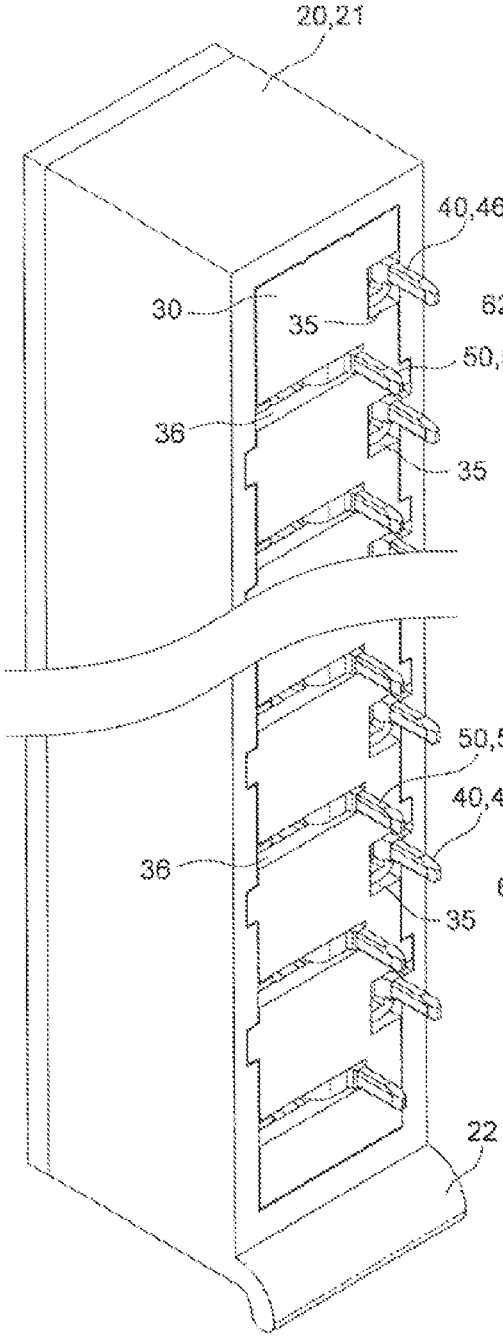
FIG. 6A is a partial perspective view of the terminal platform shown in FIGS. 1A and 1B.
Figure 6B:
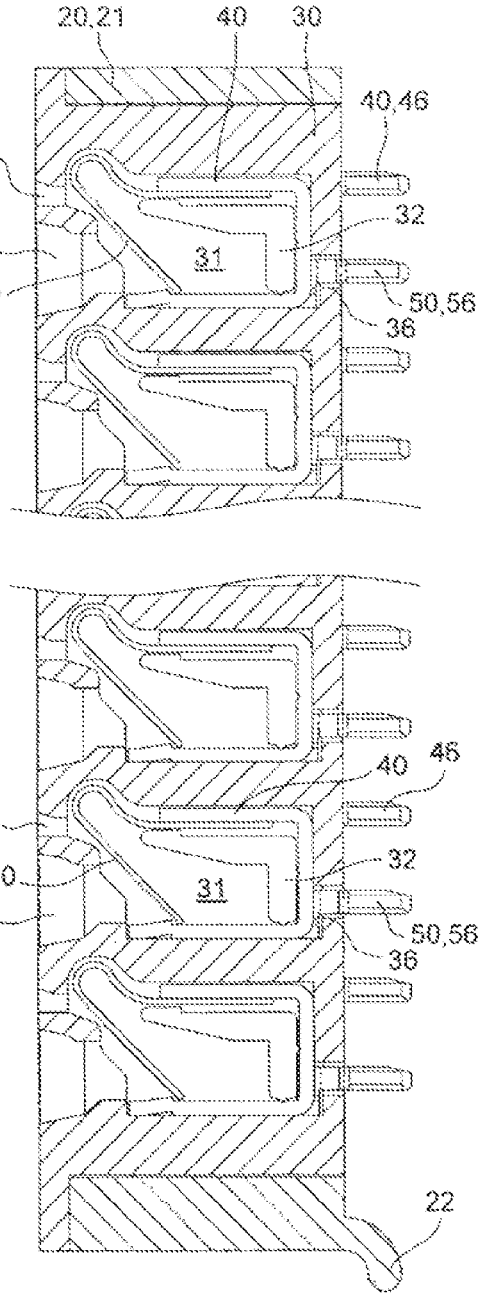
FIG. 6B is a sectional view taken along line VI-VI in FIG. 4B.

Embodiments of a conductor connection tool according to the present invention will be described with reference to FIGS. 1A to 14B. Identical elements shown in the various figures are designated with the same reference numerals.

As shown in FIGS. 1A to 10B, a conductor connection tool according to a first embodiment in a case where the conductor connection tool is applied to a relay unit of conductors, and the relay unit includes a relay unit main body 10, and a terminal platform 20.

In the relay unit main body 10, connection holes 11, 12 are arranged on one side end surface of a vertically-long, flat, and square housing in a zigzag form in the up and down direction, and a hinge receiving portion 13 is provided in a lower edge of the one side end surface. Terminal receiving fittings 15 to be described later are respectively assembled in the connection holes 11, 12.

As shown in FIGS. 3A to 10B, the terminal receiving fitting 15 is a press-molded item having a pair of elastic arm portions 16, 16 arranged in parallel, and a retaining projection 17 protrudes from a base part of the elastic arm portions 16. A connection terminal portion 18 is sheared and bent at a substantially right angle from the base part of the elastic arm portions 16, 16, and a retaining projection 19 is provided in a base part of the connection terminal portion 18.

As shown in FIGS. 4A to 6B, the terminal platform 20 includes a frame shape cover 21, and a terminal platform base 30 having an outer circumferential shape to be fittable to the cover 21, in which conduction fittings 40, 50 and plate springs 60 are respectively assembled on both side surfaces.

The cover 21 is formed in a frame shape to be fitted to an outer circumferential surface of the terminal platform base 30 so as to cover the terminal platform base 30, and a hinge portion 22 is provided in a lower edge on the back surface side thereof.

Figure 7A:
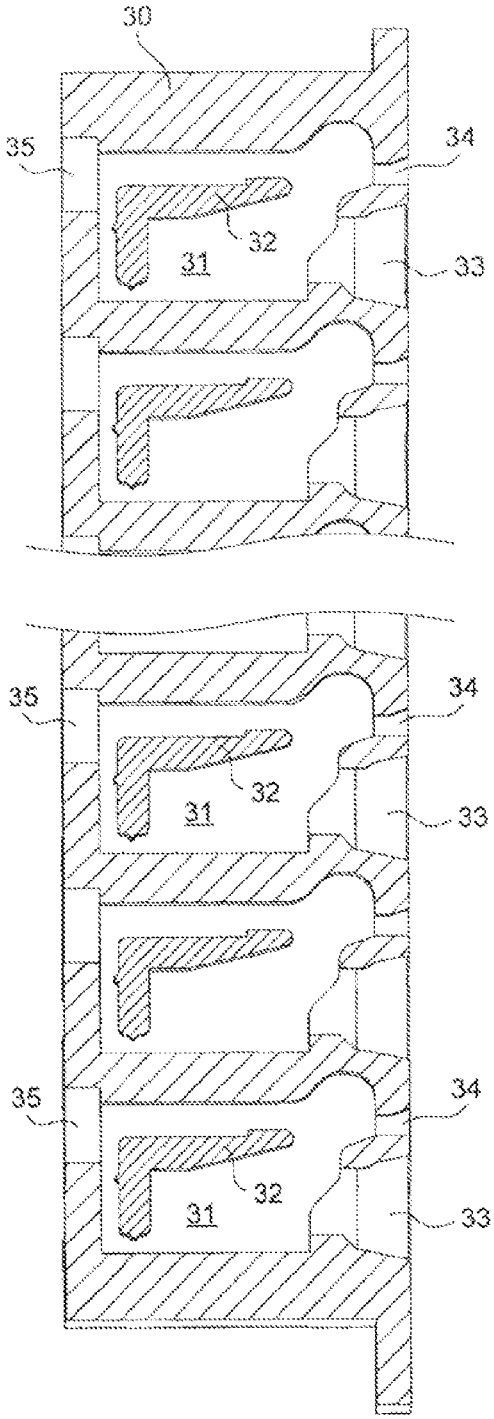
FIGS. 7A and 7B are a left side sectional view and a partial right side sectional view of a terminal platform base forming the terminal platform.
Figure 7B:
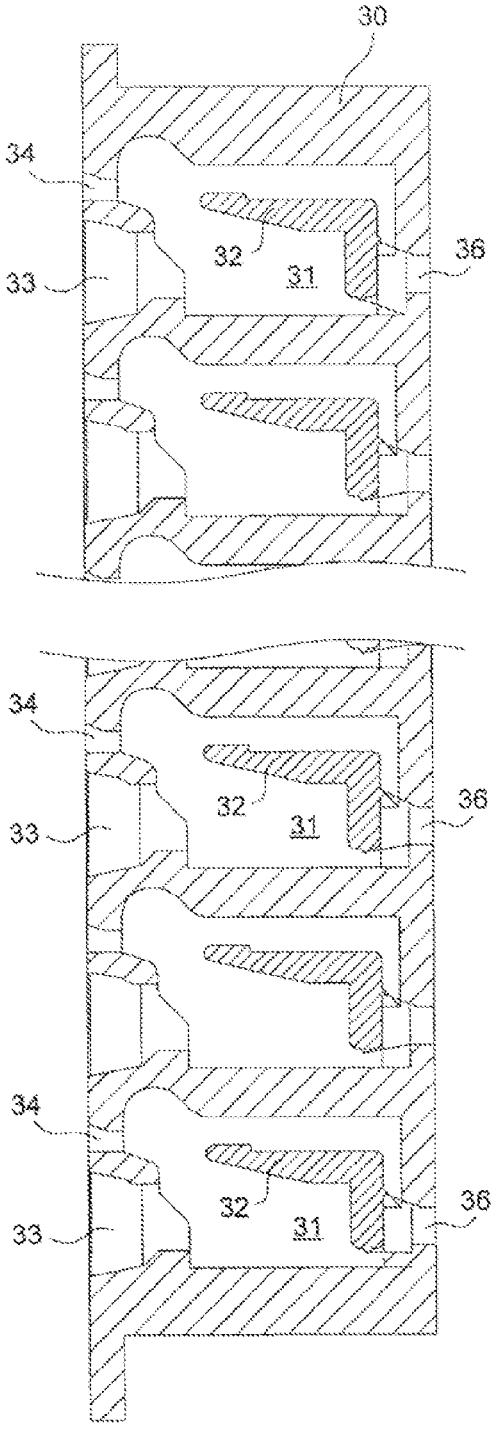

In the terminal platform base 30, as shown in FIGS. 7A and 7B, fitting recessed parts 31 are respectively provided at a predetermined pitch in the up and down direction on both side surfaces thereof, and substantially L shape positioning ribs 32 protrude from bottom surfaces of the fitting recessed parts 31. In the terminal platform base 30, conductor insertion holes 33 communicating with the fitting recessed parts 31, and operation holes 34 into which operation jigs (not shown) can be inserted are provided on a front surface thereof. Meanwhile, in the terminal platform base 30, slits 35, 36 communicating with the fitting recessed parts 31, from which terminal portions of the conduction fittings 40, 50 protrude are provided in a zigzag form in both side edges of a back surface thereof (refer to FIGS. 4A, 4B, 6A, and 6B).

Figure 8A:
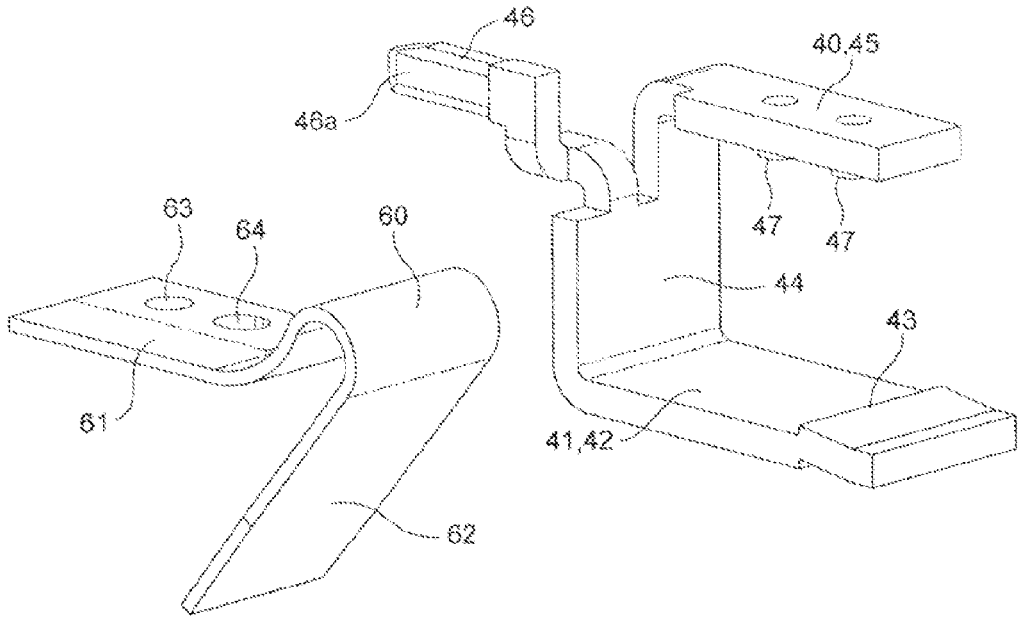
FIGS. 8A and 8B are perspective views showing states before and after connecting the connection fitting and a plate spring.
Figure 8B:
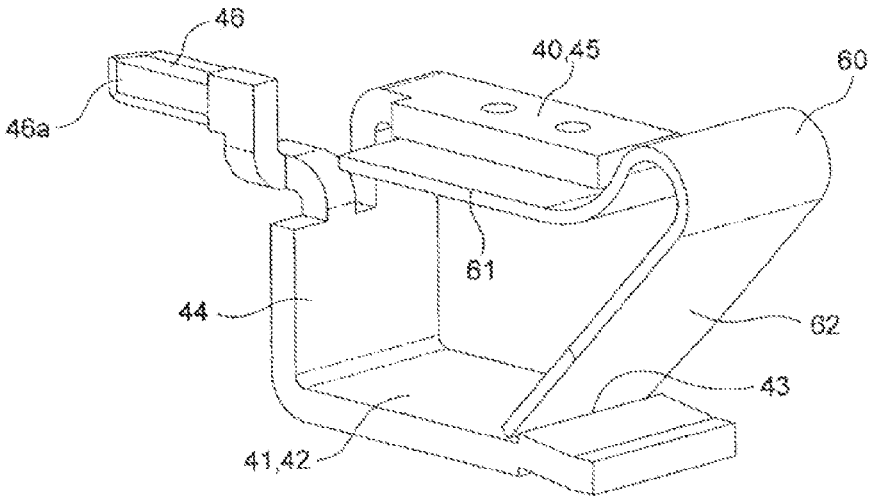

As shown in FIGS. 8A and 8B, the conduction fitting 40 is a press-molded item in which a terminal portion 46 protrudes in the horizontal direction from a fitting main body 41 formed in a substantially U shape in a front view.

That is, a locking claw portion 43 protrudes on the one end side of a bottom plate portion 42 of the fitting main body 41, while a vertical portion 44 is bent vertically upward from the other end of the bottom plate portion 42. An attachment portion 45 formed by one piece on the far side of an upper end of the vertical portion 44, the one piece being a half or more of the upper end extends so as to be parallel to the bottom plate portion 42, while the terminal portion 46 formed by the remaining one piece on the near side of the upper end is sheared and bent in the opposite direction to the attachment portion 45. Particularly, the terminal portion 46 is bent upward in such a manner that a roll surface 46*a* thereof becomes a vertical surface. It should be noted that a pair of assembling projections 47, 47 protrudes from the attachment portion 45 by projection processing.

The plate spring 60 is bent in a substantially V shape with one end side serving as an attachment piece 61 while the other end side serving as a locking piece 62. In the plate spring 60, a circular assembling hole 63 and an oval assembling hole 64 are provided along one side edge of the attachment piece 61. By respectively fitting and assembling the circular assembling hole 63 and the oval assembling hole 64 of the plate spring to the assembling projections 47, 47 of the conduction fitting 40, both are integrated and a front end of the locking piece 62 is locked onto the locking claw portion 43 of the conduction fitting 40.

According to the present embodiment, the conduction fitting 40 is formed in a substantially U shape in a front view. Thus, a large developing area is not required, and the number of the conduction fitting 40 to be cut out from a plate shape conductive material of a single area is increased. Therefore, there is an advantage that production cost can be reduced.

Further, the attachment piece 61 of the substantially V shape plate spring 60 is fixed to the attachment portion 45 of the fitting main body 41 formed in a substantially U shape in a front view. Thus, conductor connection with a strong holding force and high contact reliability can be realized.

By providing the pair of circular assembling hole 63 and oval assembling hole 64 in the plate spring 60, the plate spring 60 can be assembled and fixed to the fitting main body 41 at two points. Thus, precise positioning can be realized. Particularly, by providing the oval assembling hole 64, there is an advantage that a positioning task is easily performed.

Figure 9A:
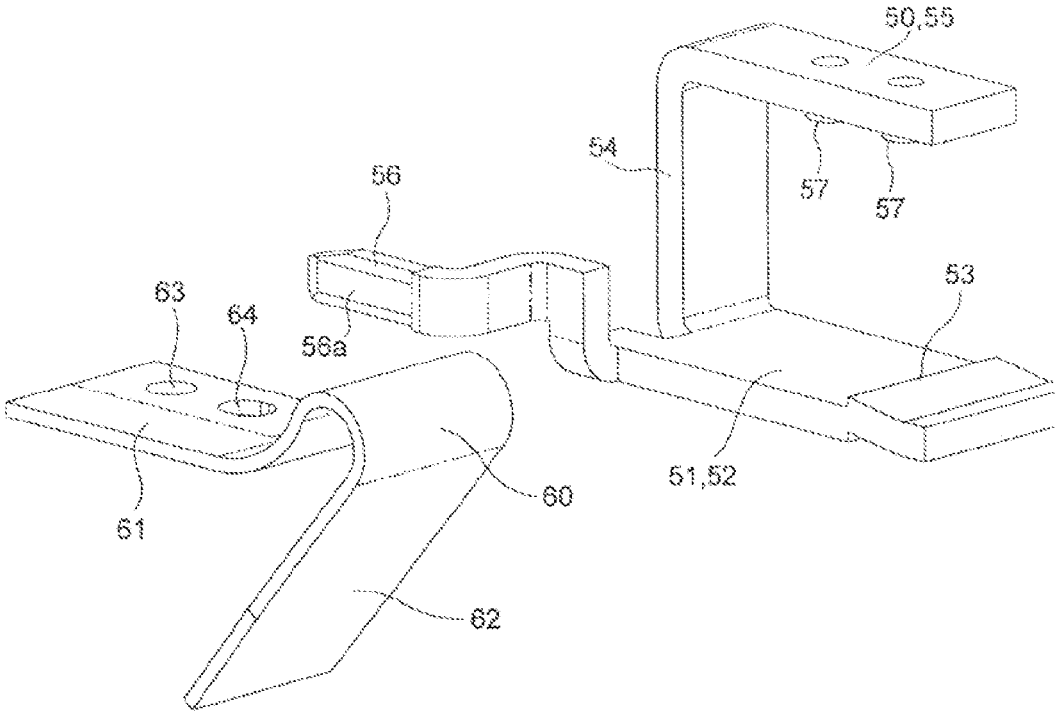
FIGS. 9A and 9B are perspective views showing states before and after connecting the connection fitting and the plate spring.
Figure 9B:
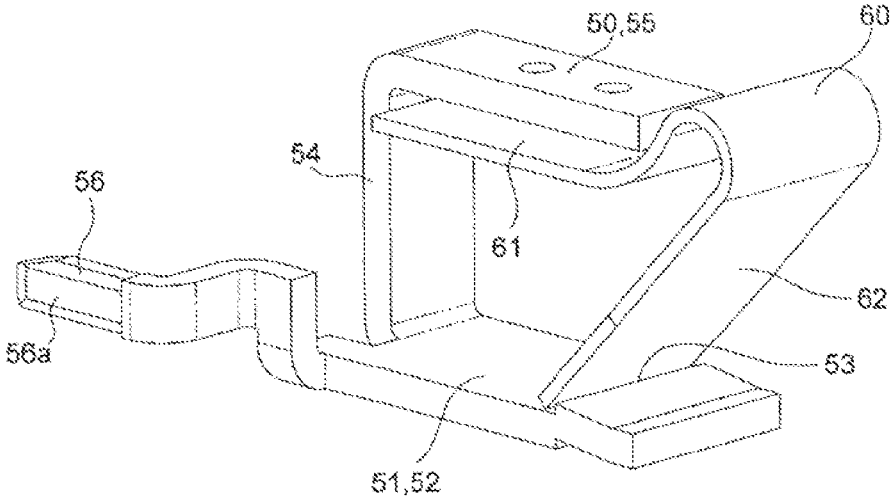
Figure 10A:
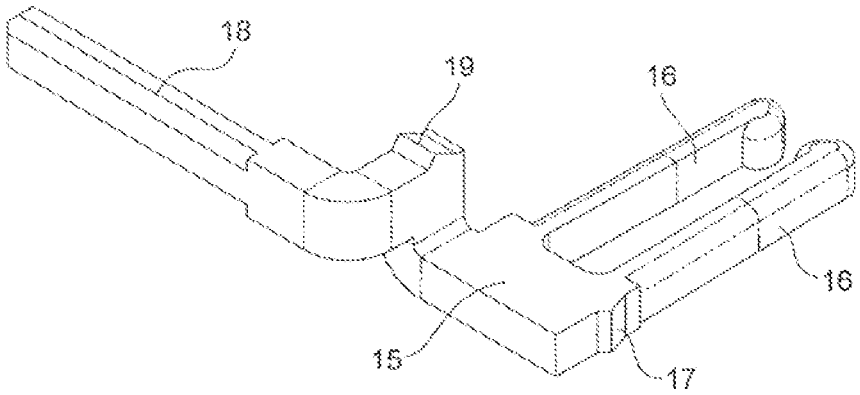
FIGS. 10A and 10B are perspective views showing the terminal receiving fitting.
Figure 10B:
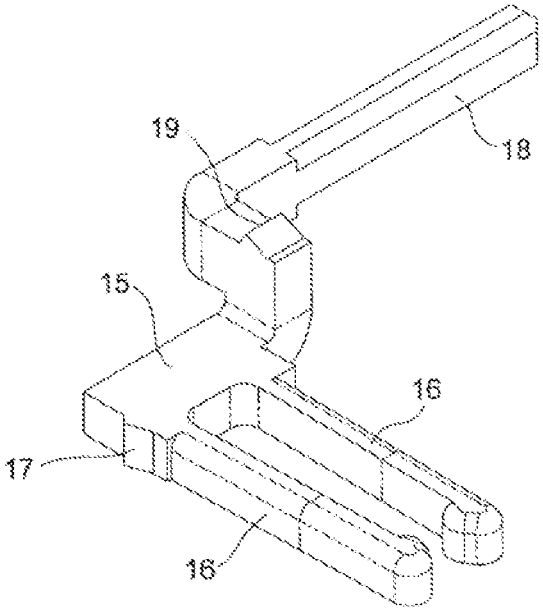

As shown in FIGS. 9A and 9B, the conduction fitting 50 is substantially the same as the above conduction fitting 40. A different point is that a terminal portion 56 is sheared and bent in the horizontal direction from the other end of a bottom plate portion 52.

That is, a locking claw portion 53 protrudes on the one end side of the bottom plate portion 52 of a fitting main body 51, while a vertical portion 54 is formed by bending one piece on the far side of the other end of the bottom plate portion 51, the one piece being a half or more of the other end, vertically upward. An attachment portion 55 extends from an upper end of the vertical portion 54 in parallel to the bottom plate portion 52. Meanwhile, the terminal portion 56 is sheared and bent from the remaining one piece on the near side of the bottom plate portion 51 in the opposite direction to the attachment portion 55. Particularly, the terminal portion 56 is bent upward in such a manner that a roll surface 56*a* thereof becomes a vertical surface. It should be noted that a pair of assembling projections 57, 57 protrudes from the attachment portion 55 by projection processing.

Next, an assembling method and a connection method of the relay unit main body 10 and the terminal platform 20 formed by the above constituent parts.

Firstly, the conduction fittings 40, 50 to which the plate springs 60 are assembled and fixed are respectively fitted and positioned into the fitting recessed parts 31, 31 provided on both the side surfaces of the terminal platform base 30 via the positioning ribs 32, 32. Thereby, the terminal portions 46, 56 of the conduction fittings 40, 50 respectively protrude from the slits 35, 36 of the terminal platform base 30. After the frame shape cover 21 is assembled to the terminal platform base 30, the hinge portion 22 thereof is engaged with the hinge receiving portion 13 of the relay unit main body 10 to which the terminal receiving fittings 15 are assembled. Next, by rotating the terminal platform 20, the terminal portions 46, 56 of the conduction fittings 40, 50 are fitted and connected between the pairs of elastic arm portions 16, 16 of the terminal receiving fittings 15, 15. Further, after the connection jigs (not shown) are pushed into the operation holes 34, and the locking pieces 62 of the plate springs 60 are elastically deformed, the conductors (not shown) are inserted from the conductor insertion holes 33, and the connection jigs are drawn out. Thereby, the locking pieces 62, 62 of the plate springs 60, 60 are elastically returned, and the conductors are respectively nipped and connected by the front ends of the locking pieces 62, 62 and the locking claw portions 43, 53 of the conduction fittings 40, 50.

In the present embodiment, the terminal platform 20 can be separated from the relay unit main body 10. Thus, the conductors can be connected to the separated terminal platform 20, so that a connection task of the conductors is easily performed.

Since the terminal platform 20 is rotatably attached to the relay unit main body 10, the connection task can be performed with a single-touch operation, so that maintenance is easily performed.

Further, among the terminal portions 46, 56 of the conduction fittings 40, 50, not fracture surfaces generated at the time of press molding but the roll surfaces 46*a*, 56*a* are fitted between the pairs of elastic arm portions 16, 16 of the terminal receiving fittings 15. Therefore, there is no variation in contact resistance, and contact surfaces of the elastic arm portions 16, 16 are not damaged. Thus, the contact reliability is high.

Further, even when the conductors are inserted from the conductor insertion holes 33 into the terminal platform base 30, front ends of the conductors are abutted with the positioning ribs 32. Thus, there is an advantage that excessive insertion of the conductors can be prevented.

As shown in FIGS. 11A to 12B, a second embodiment according to the present invention is a case where the conductor connection tool is applied to the terminal platform 20 in which one conduction fitting 40 is assembled to the terminal platform base 30, whereas the above first embodiment is a case where the plurality of conduction fittings is used.

In the terminal platform 20 according to the present embodiment, the conduction fitting 40 and the plate spring 60 are assembled and an operation button 70 is also assembled to the terminal platform base 30.

Figure 11A:
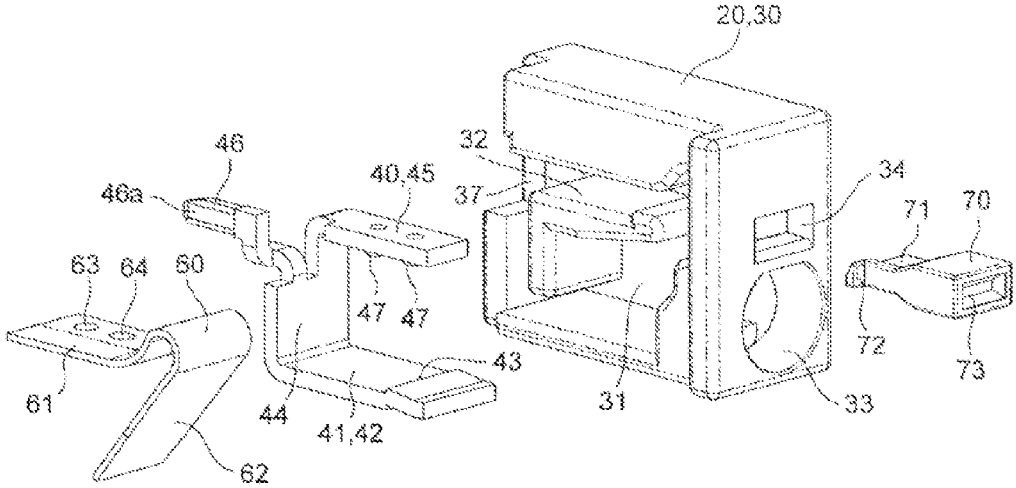
FIGS. 11A, 11B, and 11C are an exploded perspective view showing a second embodiment of the conductor connection tool according to the present invention, a perspective view showing a state in the middle of assembling, and a perspective view showing a state after the assembling.
Figure 11B:
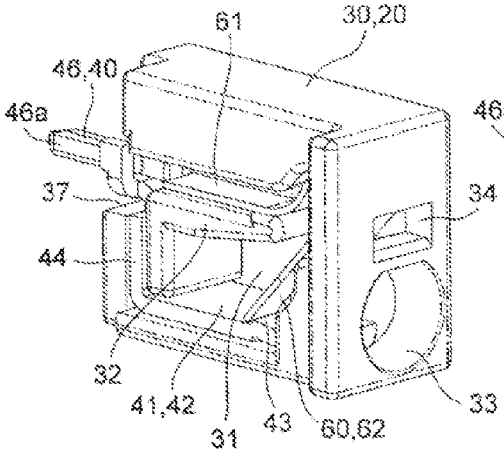
Figure 11C:
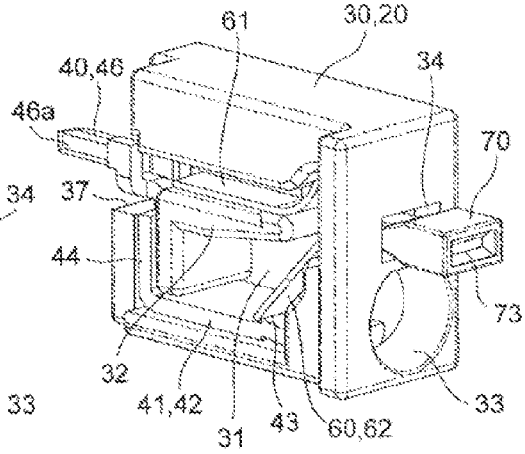

In the terminal platform base 30, as shown in FIGS. 11A to 11C, the fitting recessed part 31 is provided on one side surface thereof, and the substantially L shape positioning rib 32 protrudes from the bottom surface of the fitting recessed part 31. In the terminal platform base 30, the conductor insertion hole 33 communicating with the fitting recessed part 31, and the operation hole 34 into which the operation button 70 can be inserted are provided on the front surface thereof. Meanwhile, in the terminal platform base 30; a cutout portion 37 communicating with the fitting recessed part 31, from which the terminal portion 46 of the conduction fitting 40 protrudes is provided on the back surface thereof.

It should be noted that since the conduction fitting 40 and the plate spring 60 are substantially the same as the above first embodiment, the same parts will be given the same reference signs and description thereof will not be repeated.

Figure 12A:
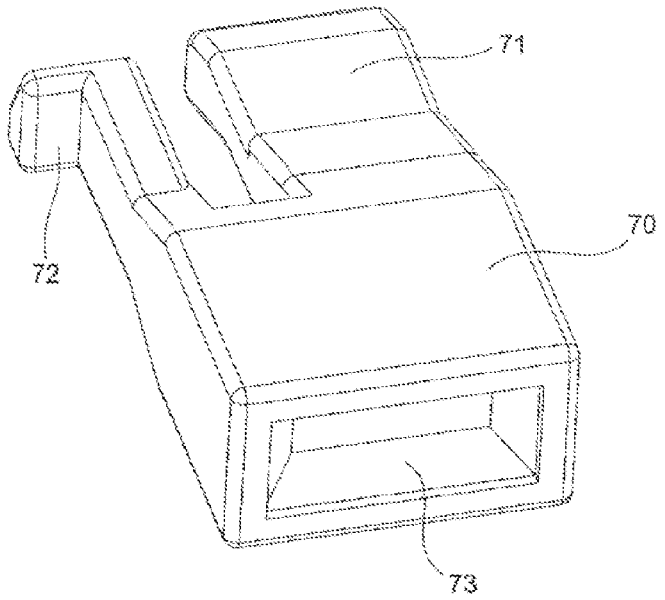
FIGS. 12A and 12B are a perspective view and a side view of an operation button shown in FIGS. 11A, 11B and 11C.
Figure 12B:
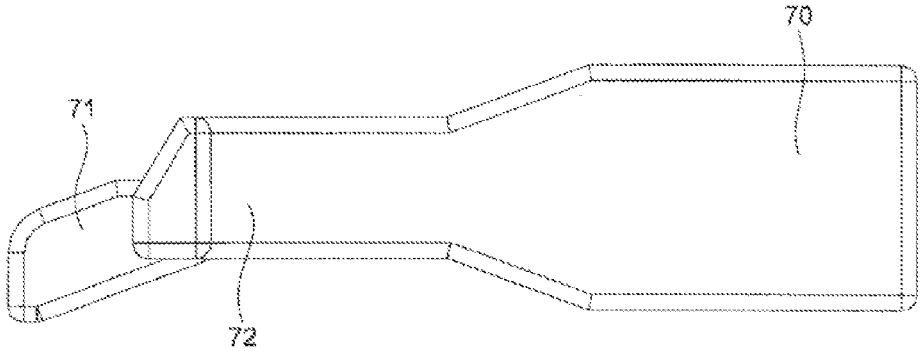

As shown in FIGS. 12A and 12B, the operation button 70 has a sectional shape to be insertable into the operation hole 34 of the terminal platform base 30, and an operating arm portion 71 and a retaining arm portion 72 are arranged in parallel on the front end side thereof while an operating recessed portion 73 is provided on a rear end surface thereof.

Therefore, the conduction fitting 40 integrated with the plate spring 60 is fitted and positioned into the fitting recessed part 31 of the terminal platform base 30 via the positioning rib 32. Next, by pushing the operation button 70 into the operation hole 34 of the terminal platform base 30 and elastically deforming and press-fitting the retaining arm portion 72, the operating arm portion 71 is abutted with the locking piece 62 of the plate spring 60.

Next, by further pushing the operating recessed portion 73 of the operation button 70, the locking piece 62 of the plate spring 60 is pushed in by the operating arm portion 71 so as to be elastically deformed. By retreating the operation button 70 after the conductor (not shown) is inserted into the conductor insertion hole 33, the conductor is nipped and connected by the front end of the locking piece 62 of the plate spring 60 and the locking claw portion 43 of the conduction fitting 40.

It should be noted that in the present embodiment, since the retaining arm portion 72 is provided in the operation button 70, there is an advantage that the operation button 70 is not dropped from the operation hole 34 of the terminal platform base 30.

Figure 13A:
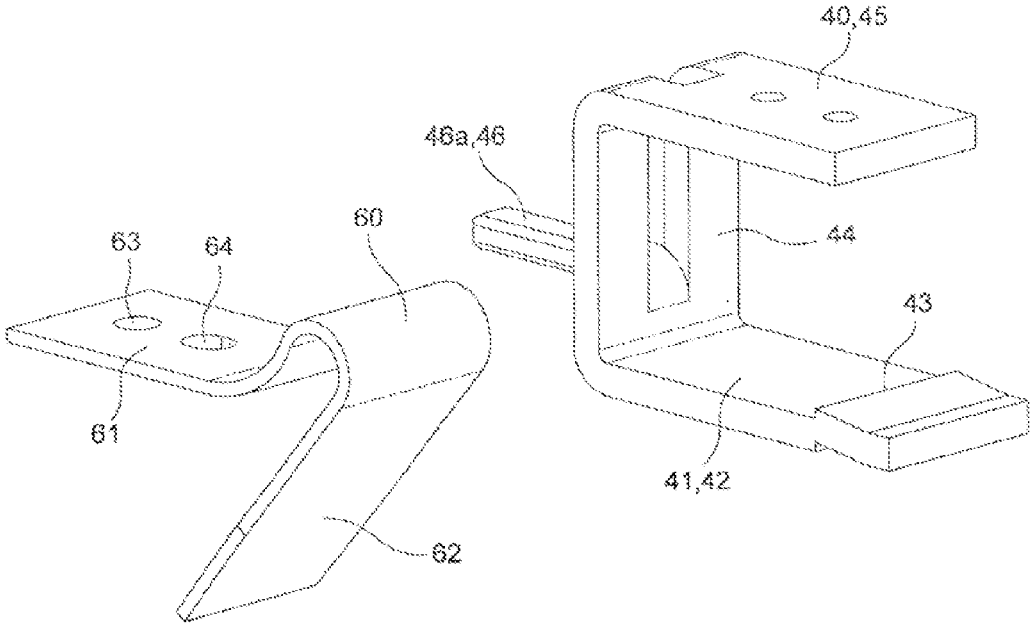
FIGS. 13A and 13B are perspective views showing states before and after assembling of a modified example of the conduction fitting and the plate spring according to the present invention.
Figure 13B:
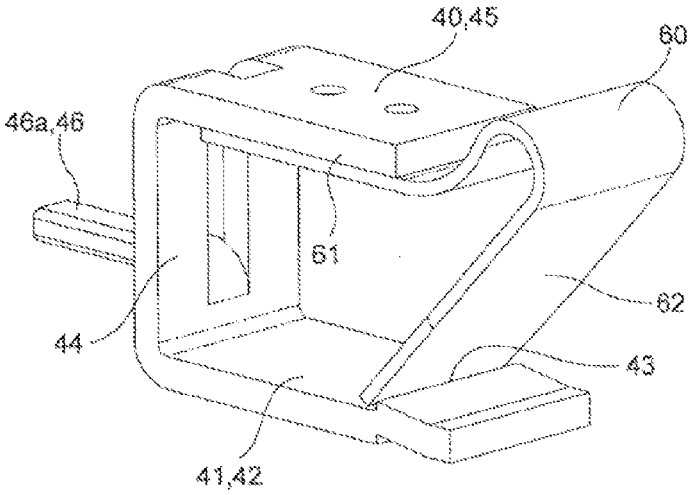

It should be noted that as shown in FIGS. 13A and 13B, the conduction fitting 40 may be a press-molded item in which the terminal portion 46 is cut out in the horizontal direction from the vertical portion 44 of the fitting main body 41 formed in a substantially U shape in a front view.

That is, the locking claw portion 43 protrudes on the one end side of the bottom plate portion 42 of the fitting main body 41, while the vertical portion 44 is bent vertically upward from the other end of the bottom plate portion 42. The attachment portion 45 extends from the upper end of the vertical portion 44 in parallel to the bottom plate portion 42, while the terminal portion 46 is sheared and bent from a center part of the vertical portion 44 in the opposite direction to the attachment portion 45. A pair of assembling projections (not shown) protrudes from the attachment portion 45 along the longitudinal direction by projection processing.

Meanwhile, the plate spring 60 is bent in a substantially V shape with the one end side serving as the attachment piece 61 while the other end side serving as the locking piece 62. In the plate spring 60, the circular assembling hole 63 and the oval assembling hole 64 are provided in center of the attachment piece 61 along the longitudinal direction. By respectively fitting and assembling the circular assembling hole 63 and the oval assembling hole 64 of the plate spring 60 to the assembling projections of the conduction fitting 40, both are integrated and the front end of the locking piece 62 is locked onto the locking claw portion 43 of the conduction fitting 40.

According to the present embodiment, there is an advantage that a twist is not generated in the attachment portion 45.

Figure 14A:
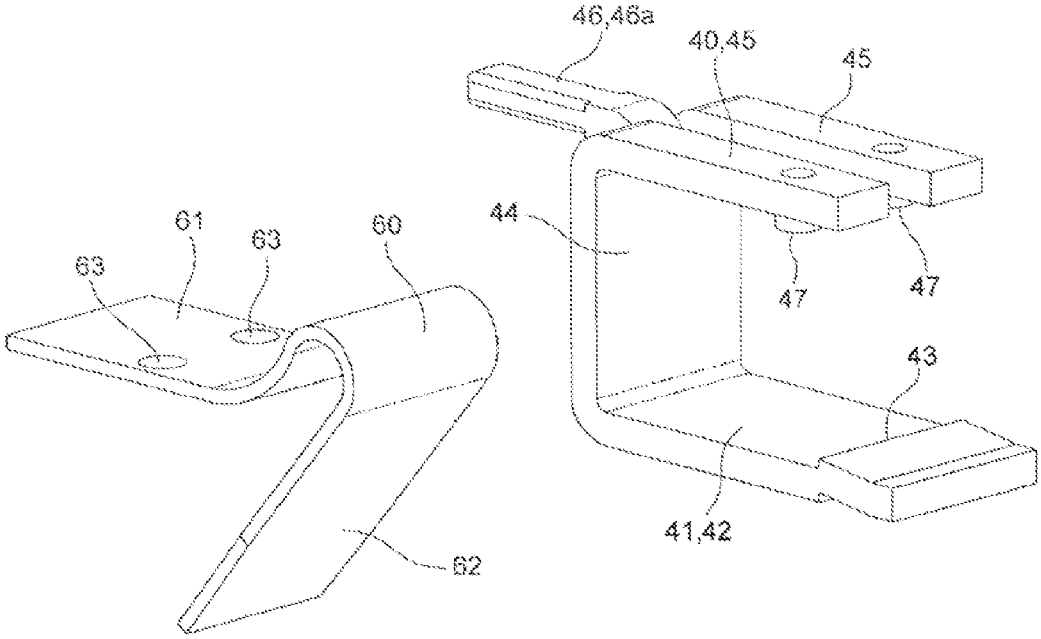
FIGS. 14A and 14B are perspective views showing states before and after assembling of another modified example of the conduction fitting and the plate spring according to the present invention.
Figure 14B:
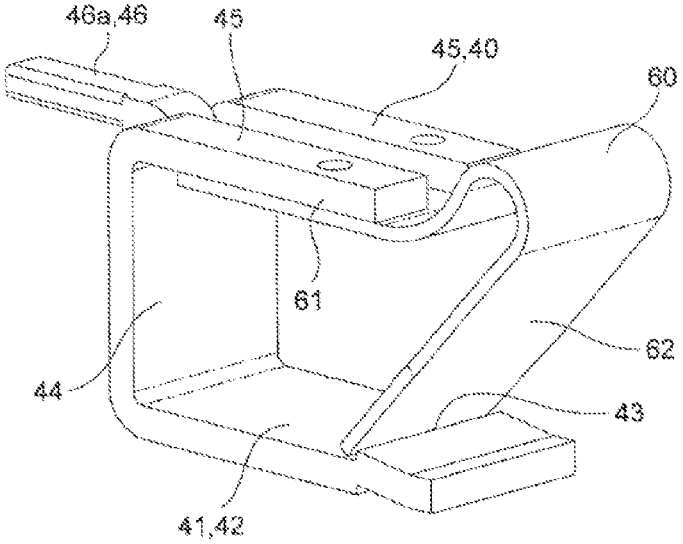

As shown in FIGS. 14A and 14B, the conduction fitting 40 may be a press-molded item in which the terminal portion 46 is cut out in the horizontal direction from upper ends of the attachment portions 45 of the fitting main body 41 formed in a substantially U shape in a front view.

That is, the locking claw portion 43 protrudes on the one end side of the bottom plate portion 42 of the fitting main body 41, while the vertical portion 44 is bent vertically upward from the other end of the bottom plate portion 42. The attachment portions 45, 45 extend from the upper end of the vertical portion 44 in parallel to the bottom plate portion 42, while the terminal portion 46 is cut out from a center part of the attachment portions 45 and bent upward in the opposite direction to the attachment portions 45. The pair of assembling projections 47, 47 respectively protrudes from the attachment portions 45, 45 by projection processing.

Meanwhile, the plate spring 60 is bent in a substantially V shape with the one end side serving as the attachment piece 61 while the other end side serving as the locking piece 62. In the plate spring 60, the circular assembling holes 63, 63 are provided in center of the attachment piece 61 along the width direction. By respectively fitting and assembling the circular assembling holes 63, 63 of the plate spring 60 to the assembling projections 47, 47 of the conduction fitting 40, both are integrated and the front end of the locking piece 62 is locked onto the locking claw portion 43 of the conduction fitting 40.

It should be noted that the conductor may be connected via an operation button in the first embodiment, and the conductor may be connected not by using the operation button but by an operation jig in the second embodiment.

The conduction fitting according to the above embodiments has a simple developed shape before bending. Thus, there is an advantage that material usage is less wasteful and yield is favorable.

The relay unit serving as the conductor connection tool according to the present invention is not limited to the above embodiments but can be applied to other shape conduction fittings and plate springs as a matter of course.

There has thus been shown and described a novel conductor connection tool and relay unit using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A conductor connection tool, comprising:

a housing;

a conduction fitting formed in a substantially U shape including a bottom plate portion, a vertical portion bent vertically upward from one end of the bottom plate portion, and an attachment portion extending from an upper end of the vertical portion in parallel to the bottom plate portion, and having a terminal portion extending in the opposite direction to the attachment portion, the conduction fitting being accommodated in a fitting recessed part of the housing; and plate spring bent in a substantially V shape with one side serving as an attachment piece to be fixed to the attachment portion of the conduction fitting with the other side serving as a looking piece whose front end is to be brought into pressure contact with a locking claw portion on the bottom plate portion of the conduction fitting, wherein by pushing in the locking piece of the plate spring via an operation hole provided on a front surface side of the housing so as to be elastically deformed, inserting a conductor from a conductor insertion hole provided on the front surface side of the housing, and then elastically returning the locking piece, the conductor is nipped by the bottom plate portion of the conduction fitting and the front end of the locking piece of the plate spring, and wherein a substantially L shape positioning rib for regulating a position of the conduction fitting protrudes from a bottom surface of the fitting recessed part of the housing.

2. The conductor connection tool according to claim 1, wherein the terminal portion is bent upward in such a manner that a roll surface to becomes a contact surface.

3. A relay unit having a main body; wherein the housing of the conductor connection tool according to claim 1 is rotatably attached to the relay unit main, body, and the terminal portion of the conduction fitting protruding from the housing is fitted and connected between a pair of elastic arm portions of a terminal receiving fitting provided in a terminal hole of the relay unit.

* * * * *